US008390538B2

(12) United States Patent
Song et al.

(10) Patent No.: US 8,390,538 B2
(45) **Date of Patent: *Mar. 5, 2013**

(54) ACTIVE-MATRIX FIELD EMISSION PIXEL

(75) Inventors: Yoon Ho Song, Daejeon (KR); Dae Jun Kim, Daejeon (KR); Jin Woo Jeong, Daegu (KR); Jin Ho Lee, Daejeon (KE); Kwang Yong Kang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/244,078

(22) Filed: Sep. 23, 2011

(65) Prior Publication Data

US 2012/0097958 A1 Apr. 26, 2012

Related U.S. Application Data

(62) Division of application No. 12/096,595, filed on Jun. 6, 2008, now Pat. No. 8,054,249.

(30) Foreign Application Priority Data

Dec. 8, 2005 (KR) ..... 10-2005-0119501
Sep. 11, 2006 (KR) ..... 10-2006-0087463

(51) Int. Cl.
*G09G 5/00* (2006.01)

(52) U.S. Cl. ..... 345/75.2; 345/204

(58) Field of Classification Search ..... 315/169.1, 315/169.2, 169.3; 345/55, 76, 77, 75.2, 74.1, 345/204, 212, 82

See application file for complete search history.

(56) References Cited

U.S. PATENT DOCUMENTS

| | | | |
|---|---|---|---|
| 5,015,912 | A | 5/1991 | Spindt et al. |
| 5,153,483 | A | 10/1992 | Kishino et al. |
| 5,402,041 | A | 3/1995 | Kishino et al. |
| 5,616,991 | A | 4/1997 | Casper et al. |

(Continued)

FOREIGN PATENT DOCUMENTS

| | | |
|---|---|---|
| JP | 03-295138 | 12/1991 |
| JP | 07-254383 | 10/1995 |

(Continued)

OTHER PUBLICATIONS

W. B. Choi et al., "Fully sealed, high-brightness carbon-nanotube field-emission display" Applied Physics Letters, vol. 75, No. 20, Nov. 15, 1999, pp. 3129-3131.

*Primary Examiner* — David H Vu
(74) *Attorney, Agent, or Firm* — Rabin & Berdo, P.C.

(57) ABSTRACT

A field emission pixel includes a cathode on which a field emitter emitting electrons is formed, an anode on which a phosphor absorbing electrons from the field emitter is formed, and a thin film transistor (TFT) having a source connected to a current source in response to a scan signal, a gate receiving a data signal, and a drain connected to the field emitter. The field emitter is made of carbon material such as diamond, diamond like carbon, carbon nanotube or carbon nanofiber. The cathode may include multiple field emitters, and the TFT may include multiple transistors having gates to which the same signal is applied, sources to which the same signal is applied, and drains respectively connected to the field emitters. An active layer of the TFT is made of a semiconductor film such as amorphous silicon, micro-crystalline silicon, polycrystalline silicon, wide-band gap material like ZnO, or an organic semiconductor.

10 Claims, 6 Drawing Sheets

U.S. PATENT DOCUMENTS

| | | | | |
|---|---|---|---|---|
| 5,939,833 | A | 8/1999 | Song et al. | |
| 5,959,599 | A | 9/1999 | Hirakata | |
| 6,608,620 | B1 | 8/2003 | Suzuki et al. | |
| 7,141,923 | B2 | 11/2006 | Song et al. | |
| 7,167,169 | B2 * | 1/2007 | Libsch et al. | 345/211 |
| 7,215,304 | B2 | 5/2007 | Tsuchiya et al. | |
| 7,889,157 | B2 | 2/2011 | Lee et al. | |
| 8,054,249 | B2 * | 11/2011 | Song et al. | 345/75.2 |
| 2002/0080099 | A1 | 6/2002 | Song et al. | |
| 2005/0127821 | A1 | 6/2005 | Song et al. | |
| 2007/0085778 | A1 * | 4/2007 | Yoshida | 345/75.2 |

FOREIGN PATENT DOCUMENTS

| | | | |
|---|---|---|---|
| JP | 09-189897 | A | 7/1997 |
| JP | 9-305139 | A | 11/1997 |
| JP | 2001-08492 | A | 3/2001 |
| JP | 2003-308030 | A | 10/2003 |
| JP | 2003-316292 | | 11/2003 |
| JP | 2005-174895 | A | 6/2005 |
| JP | 2005-258236 | A | 9/2005 |
| KR | 2000-0034644 | | 6/2000 |
| KR | 2002-0091620 | | 12/2002 |

* cited by examiner

ACTIVE-MATRIX FIELD EMISSION PIXEL

This is a Divisional of U.S. application Ser. No. 12/096,595, filed Jun. 6, 2008, now U.S. Pat. No. 8,054,249.

TECHNICAL FIELD

The present invention relates to a field emission display (FED) that is a flat panel display employing field emission devices, i.e., field emitters.

BACKGROUND ART

An FED is fabricated by vacuum-packaging a cathode plate having a field emitter array and an anode plate having a phosphor in parallel with each other at a narrow interval (within 2 mm) The FED is a device colliding electrons emitted from the field emitters of the cathode plate with the phosphor of the anode plate and displaying an image using the cathodoluminescence of the phosphor. Recently, FEDs are widely being researched and developed as a flat panel display capable of substituting for conventional cathode ray tubes (CRTs).

The field emitter that is a core component of a FED cathode plate shows significantly different efficiency according to a device structure, an emitter material and an emitter shape. The structures of current field emission devices can be roughly classified into a diode type composed of a cathode and an anode and a triode type composed of a cathode, a gate and an anode. In the triode-type FED, the cathode or a field emitter performs a function of emitting electrons, the gate serves as an electrode inducing electron emission, and the anode performs the function of receiving the emitted electrons. In the triode structure, electrons are easily emitted by an electric field applied between the cathode and the gate. Thus, the triode-type field emission device can operate at a lower voltage than the diode-type field emission device and easily control electron emission. Consequently, triode-type FEDs are widely being developed.

A field emitter material includes metal, silicon, diamond, diamond like carbon, carbon nanotube, carbon nanofiber, and so on. Carbon nanotube and carbon fiber are fine and sharp and thus are recently and frequently used as the emitter material.

FIG. 1 is a cross-sectional view showing a carbon field emitter made of carbon nanotube, carbon nanofiber, etc and the constitution of an active-matrix FED pixel using the same. FIG. 2 is a schematic diagram illustrating a driving method of the active-matrix FED shown in FIG. 1 according to conventional art.

The illustrated active-matrix FED includes a cathode plate and an anode plate vacuum-packaged to face each other in parallel. Here, the cathode plate comprises a glass substrate 100, a thin film transistor (TFT) 110 formed on a part of the glass substrate 100, a carbon field emitter 120 formed on a part of a drain electrode of the TFT 110, a gate hole 130 and a gate insulating layer 140 surrounding the carbon field emitter 120, and a field emitter gate 150 formed on a part of the gate insulating layer 140. The anode plate comprises a glass substrate 160, a transparent electrode 170 formed on a part of the glass substrate 160, and a red, green or blue phosphor 180 formed on a part of the transparent electrode 170.

In FIG. 1, the TFT 110 comprises a transistor gate 111 formed on the cathode glass substrate 100, a transistor gate insulating layer 112 covering the transistor gate 111 and the cathode glass substrate 100, a TFT active layer 113 formed on the transistor gate insulating layer 112 on the transistor gate 111, a source 114 and a drain 115 of the TFT formed on both ends of the active layer 113, a source electrode 116 of the TFT formed on the source 114 and a part of the gate insulating layer 112, and a drain electrode 117 of the TFT formed on the drain 115 and a part of the gate insulating layer 112.

As illustrated in FIG. 2, the cathode plate of the FED shown in FIG. 1 has the carbon field emitter 120 connected with the TFT through the drain electrode 117 of the TFT in each pixel defined by row signal lines R1, R2, R3, . . . and column signal lines C1, C2, C3, . . . . The gate 111 of the TFT is connected to each row signal line R1, R2, R3, . . . , and the source electrode 116 of the TFT is connected to each column signal line C1, C2, C3, . . . . A scan signal and a data signal of the display are transferred to the TFT gate 111 and the source electrode 116 through the row signal lines and the column signal lines, respectively. Here, the scan signal and data signal of the display are applied as pulse voltage signals, and the gray scale of the display is obtained by modulating the width or amplitude of a data pulse signal.

When the FED of FIGS. 1 and 2 operates, a constant direct current (DC) voltage is applied to the field emitter gate 150 so as to induce the field emitter 120 to emit electrons, and a high DC voltage is applied to the transparent electrode 170 so as to accelerate the electrons emitted from the field emitter 120 to high energy. When one row is selected by a high level voltage H of the scan signal, the TFT is turned on while the data signal has a low level voltage L. Consequently, luminescence occurs while the data signal has the low level voltage L.

Since the TFT is turned on/off by the scan signal applied to the TFT gate 111 and the data signal applied to the source electrode 116 of the TFT, the conventional active-matrix FED of FIG. 2 can operate at low addressing voltage regardless of the voltage applied to the field emitter gate 150 but has a drawback described below.

When the active-matrix FED operates based on the voltage signals as illustrated in FIG. 2, the performance of the display totally depends on the characteristics of the TFT 110 in each pixel. In particular, when voltage required for field emission becomes considerably high, a high voltage is also induced to the drain of the TFT and then the source-drain leakage current of the TFT 110 is high or itself. Thus, the amount of the source-drain leakage current may be considerably large, which results in severe deterioration in contrast ratio and uniformity of the display.

DISCLOSURE OF INVENTION

Technical Problem

The present invention is directed to an active-matrix field emission display (FED) capable of operating on the basis of current.

The present invention is also directed to an active-matrix FED capable of preventing leakage current caused by thin film transistors (TFTs).

Technical Solution

One aspect of the present invention provides a field emission pixel comprising: a cathode on which a field emitter for emitting electrons is formed; an anode on which a phosphor for absorbing the electrons emitted from the field emitter is formed; and a thin film transistor (TFT) having a source connected to a current source according to a scan signal, a gate for receiving a data signal, and a drain connected to the field emitter.

Another aspect of the present invention provides a field emission display (FED) comprising: a plurality of unit pixels including an emission element in which cathode luminescence of a phosphor occurs and a TFT for driving the emission element; a current source for applying a scan signal to each unit pixel; and a voltage source for applying a data signal to each unit pixel. Here, the on-current of the current source is high enough to take care of the load resistance and capacitance of a scan row within a given writing time, and the off-current of the current source is so low that the electron emission of each pixel can be ignored. In addition, the pulse amplitude or pulse width of the data signal applied from the voltage source is changed, and thereby the gray scale of the display is represented.

Advantageous Effects

According to the present invention, in an active-matrix field emission display (FED) comprising field emitters and thin film transistors (TFTs), a scan signal and a data signal of the display are respectively input to a source electrode and a gate of a TFT in each pixel, the scan signal and the data signal are respectively applied as a current source and a voltage source, and thereby each pixel is driven. Therefore, the contrast ratio and uniformity of the display can be significantly improved even though the source-drain leakage current of the TFTs is high.

In addition, each cathode pixel of the FED is composed of a first and second TFTs connected in series to each other and a field emitter formed on a part of a drain electrode of the second TFT, so that intra-pixel uniformity as well as inter-pixel uniformity can be considerably improved. In addition, endurance for high voltage is significantly increased by the first and second TFTs connected in series to each other, so that the life span of the FED can be greatly improved.

MODE FOR THE INVENTION

Hereinafter, exemplary embodiments of the present invention will be described in detail with reference to FIGS. 3 to 6. However, the present invention is not limited to the exemplary embodiments disclosed below, but can be implemented in various forms. Therefore, the present exemplary embodiments are provided for complete disclosure of the present invention and to fully convey the scope of the present invention to those of ordinary skill in the art.

First Exemplary Embodiment

Figure 3:
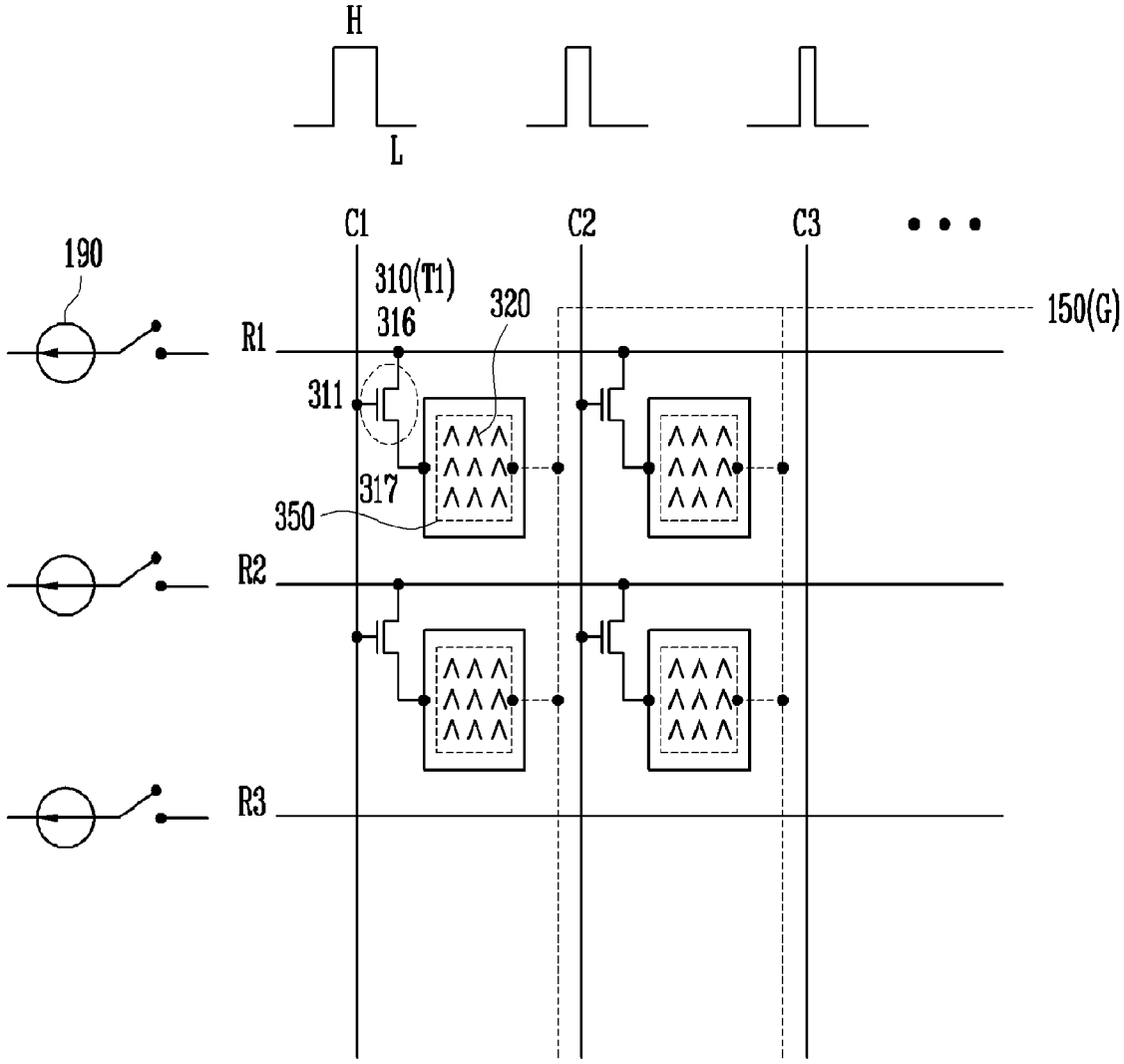
FIG. 3 is a circuit diagram of an active-matrix FED according to an exemplary embodiment of the present invention.

FIG. 3 illustrates an active-matrix field emission pixel and a driving method of a field emission display (FED) including the same according to an exemplary embodiment of the present invention.

As described in FIG. 3, a cathode plate includes pixels formed at intersecting points of horizontal (row) signal lines R1, R2, R3, . . . and vertical (column) signal lines C1, C2, C3, . . . in a matrix, each pixel is composed of one thin film transistor (TFT) 310 and a field emitter 320 connected to a drain of the TFT 310. A source electrode 316 of the TFT is connected to each row signal line R1, R2, R3, . . . , and a gate 311 of the TFT is connected to each column signal line C1, C2, C3, . . . . A scan signal and a data signal of the display are respectively transferred to the source electrode 316 and the gate 311 of the TFT through the row signal lines and column signal lines, and thereby each pixel is driven.

An active layer of the TFT 310 may be made of a semiconductor film such as amorphous silicon, micro-crystalline silicon, polycrystalline silicon, wide-band gap material like ZnO, or an organic semiconductor. The field emitter 320 may be made of a carbon material such as diamond, diamond like carbon, carbon nanotube, carbon nanofiber, and so on.

Figure 1:
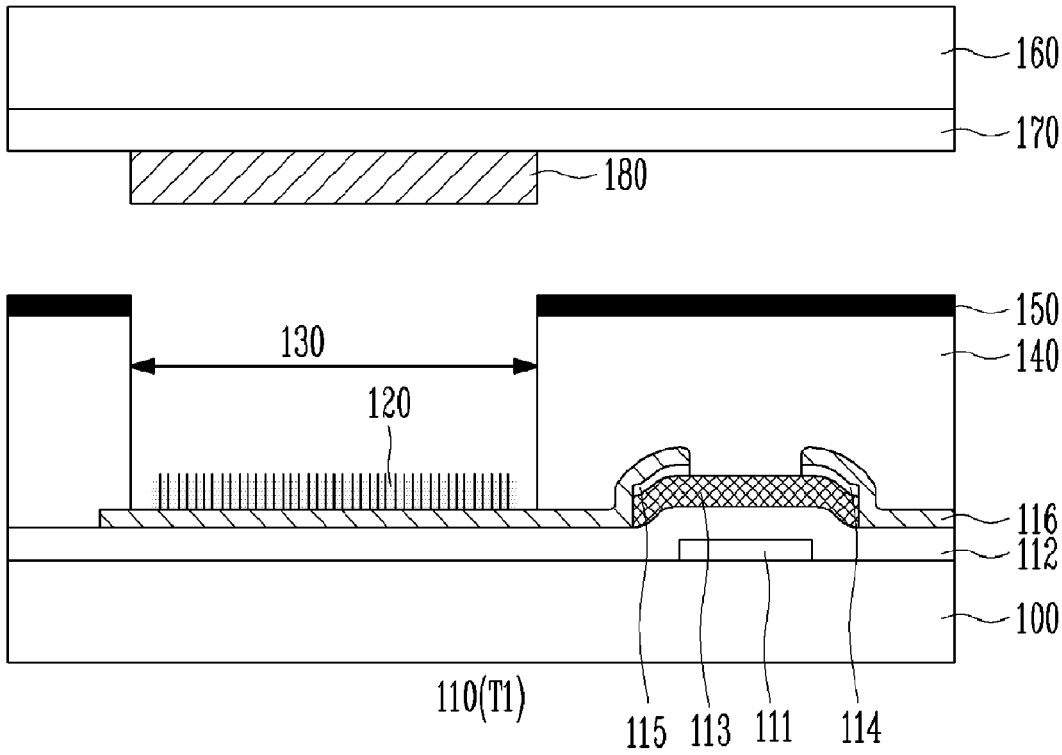
FIG. 1 is a cross-sectional view showing the constitution of a pixel of an active-matrix field emission display (FED)
Figure 2:
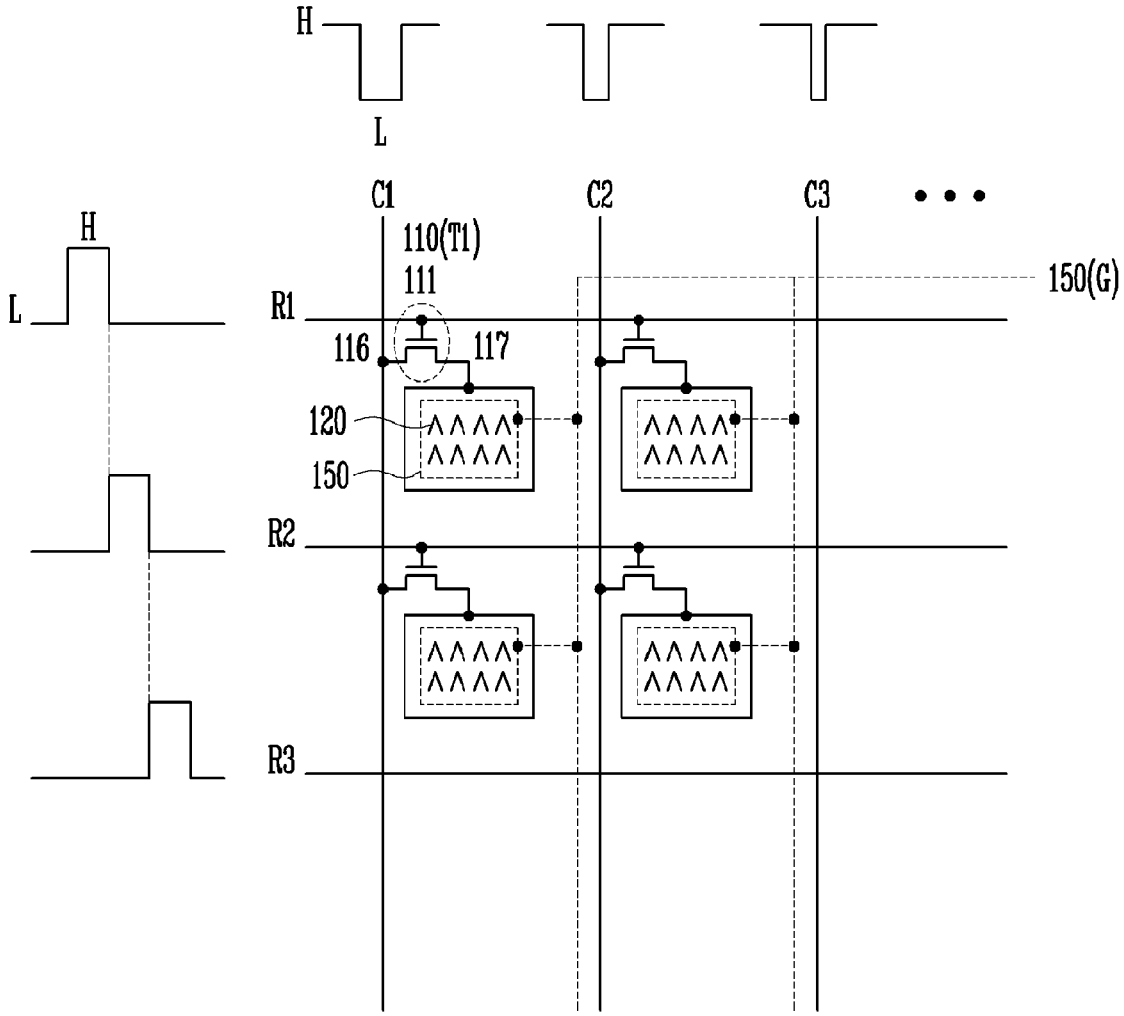
Fig. 2 PRIOR ART
FIG. 2 is a diagram illustrating a driving method of an active-matrix FED according to conventional art.

Similar to the general field emission pixel illustrated in FIG. 1, a field emitter gate and a gate insulating layer including a gate hole may be formed around the field emitter 320 so as to emit electrons from the field emitter, in a body with the cathode plate or on a separate substrate from the cathode plate. The cathode plate may be combined with an anode plate by a vacuum packaging process. A part of the cathode plate at which a field emitter exists at an intersecting point of one row signal line and one column signal line is called a cathode. In addition, a part of the anode plate at which a phosphor exists at an intersecting point of one row signal line and one column signal line is called an anode. The cathode and anode constitute an emission element of one pixel in the display.

In FIG. 3, the scan signal of the display is generated by a current source 190. The on-current of the current source 190 is high enough to take care of the load resistance and capacitance of a scan row within a given writing time, and the off-current of the current source 190 is so low that the electron emission of each pixel can be ignored. The data signal of the display is generated by a voltage source (not shown). The gray scale of the display is represented by changing the amplitude or pulse width of the data signal having a high level voltage H.

Second Exemplary Embodiment

Figure 4:
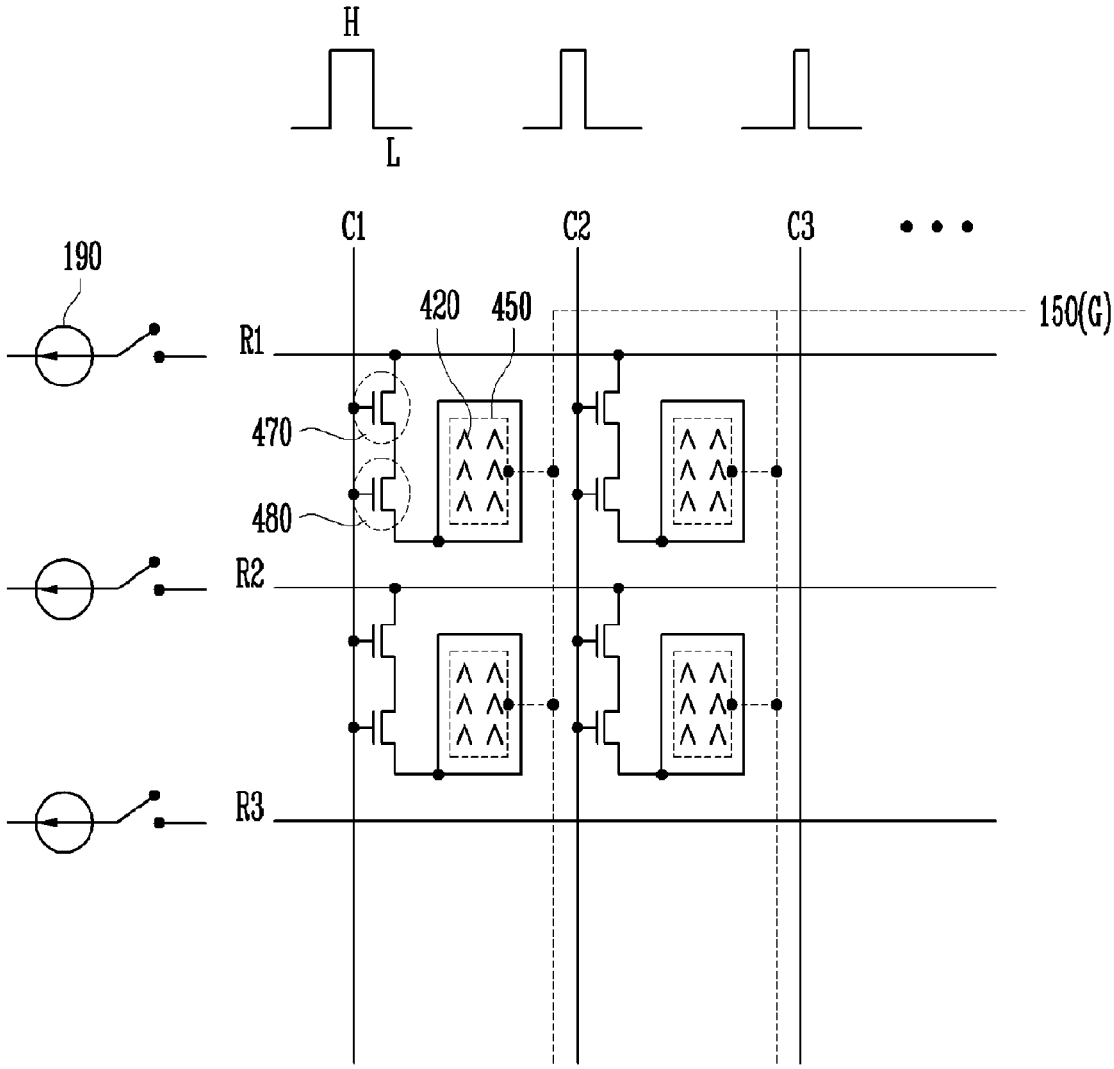
FIG. 4 is a circuit diagram of an active-matrix FED according to another exemplary embodiment of the present invention.

FIG. 4 illustrates an active-matrix field emission pixel and a driving method of a FED including the same according to another exemplary embodiment of the present invention.

This embodiment of FIG. 4 is basically the same as the first exemplary embodiment of FIG. 3. However, in this embodiment, a TFT of each pixel includes a first TFT 470 and a second TFT 480 connected in serial to each other, a source electrode of the first TFT 470 is connected to a row signal line, gates of the first and second TFTs 470 and 480 are connected to a column signal line, and a field emitter 420 is connected to a drain electrode of the second TFT 480. Here, the drain electrode of the first TFT 470 is connected to the source electrode of the second TFT 480.

The first TFT 470 of FIG. 4 has a general structure operating at a typical drain voltage. Preferably, the second TFT 480 has an offset length (Loft) to prevent the gate and drain thereof from vertically overlapping each other, and thus may be implemented by a high-voltage TFT capable of sustaining a drain voltage of 25 V or more.

When each pixel includes the first TFT 470 and the second TFT 480 and the second TFT 480 can sustain a high voltage as described above, reliability for a high voltage required for field emission can be significantly improved. Consequently, the life span of the FED can be significantly increased.

Third Exemplary Embodiment

Figure 5:
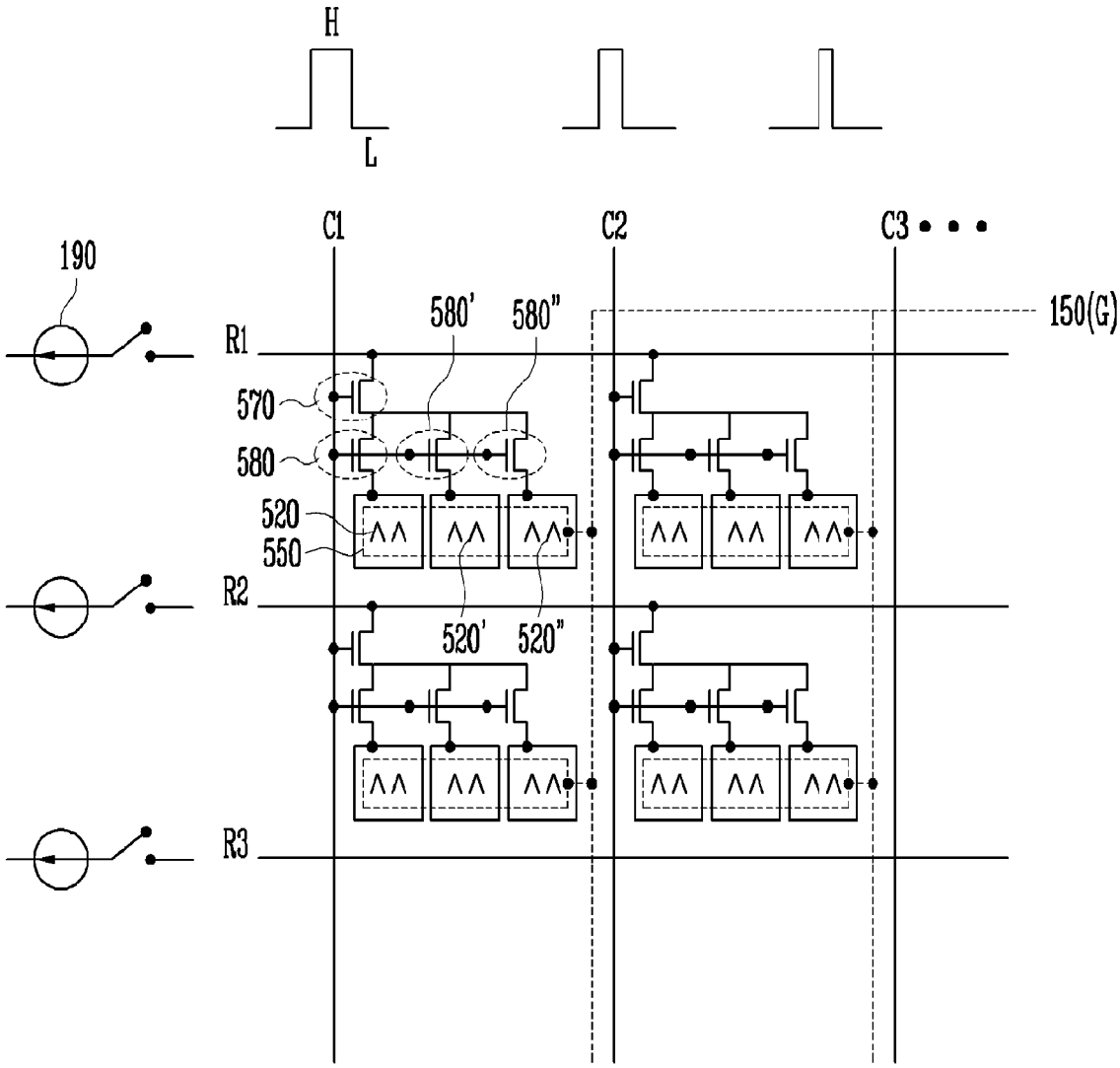
FIG. 5 is a circuit diagram of an active-matrix FED according to still another exemplary embodiment of the present invention.

FIG. 5 illustrates an active-matrix field emission pixel and a driving method of a FED including the same according to still another exemplary embodiment of the present invention.

This embodiment of FIG. 5 is basically the same as the second exemplary embodiment of FIG. 4. However, in this embodiment, a second TFT connected to a first TFT 570 is composed of a plurality of high-voltage TFTs 580, 580' and 580", and source electrodes of the second TFTs 580, 580' and 580" are connected to a drain electrode of the first TFT 570 in parallel. In addition, separate field emitters 520, 520' and 520" are respectively connected to the drain electrodes of the second TFTs 580, 580' and 580", and the field emitters 520, 520' and 520" have a common field emitter gate 550.

When each pixel is composed of the first TFT 570 and the plurality of second TFTs 580, 580' and 580", and the separate field emitters 520, 520' and 520" are respectively connected to the drain electrodes of the second TFTs 580, 580' and 580" as shown in FIG. 5, intra-pixel uniformity as well as inter-pixel uniformity can be significantly improved.

Fourth Exemplary Embodiment

Figure 6:
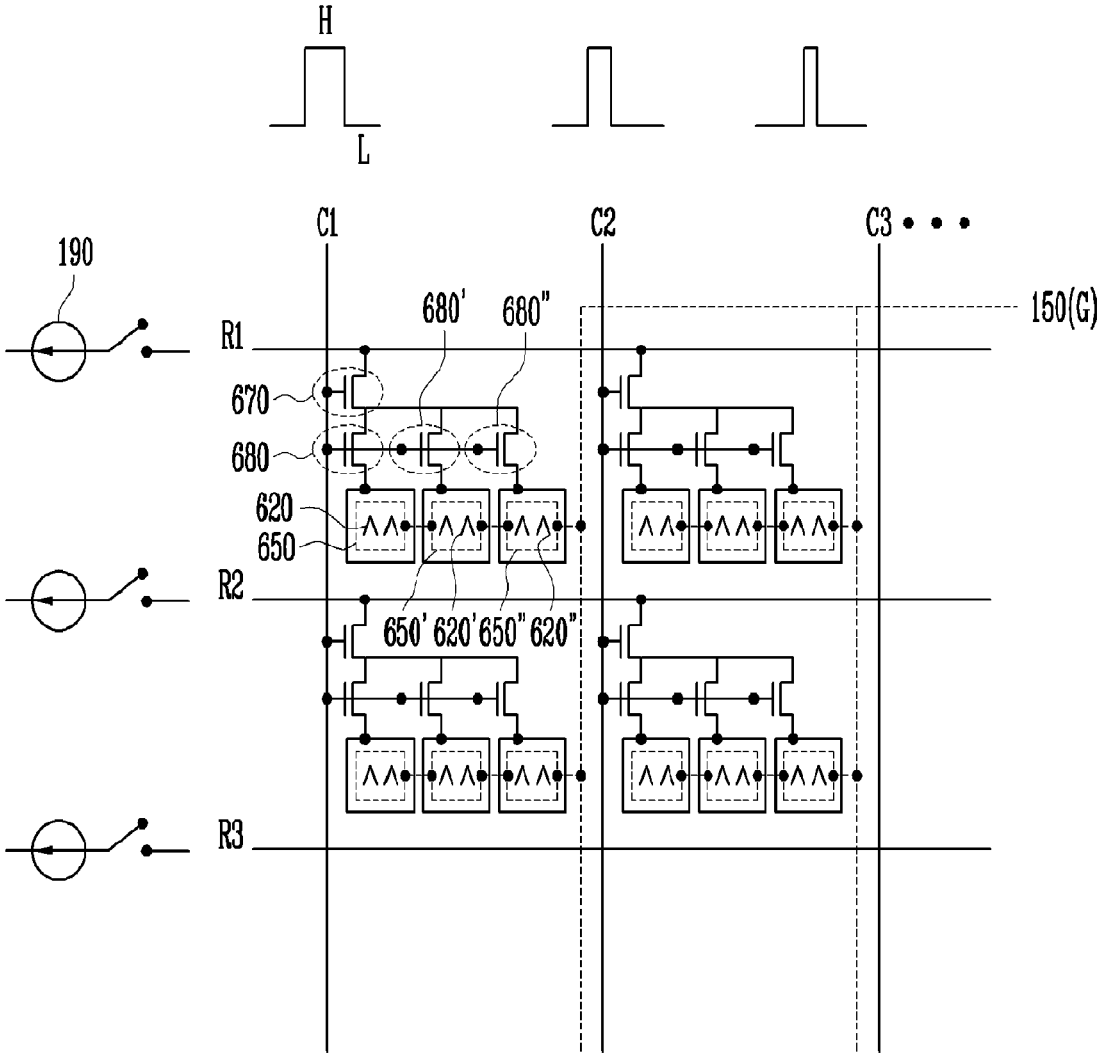
FIG. 6 is a circuit diagram of an active-matrix FED according to yet another exemplary embodiment of the present invention.

FIG. 6 illustrates an active-matrix field emission pixel and a driving method of a FED including the same according to yet another exemplary embodiment of the present invention.

This embodiment of FIG. 6 is basically the same as the third exemplary embodiment of FIG. 5. However, in this embodiment, field emitter gates 650, 650' and 650" respectively connected to field emitters 620, 620' and 620" formed on drain electrodes of second TFTs 680, 680' and 680" are separately constituted.

When the respective field emitter gates 650, 650' and 650" of the field emitters 620, 620' and 620" are separately constituted as shown in FIG. 6, a voltage required for field emission can be considerably lowered. Thus, the voltage induced to TFTs 670, 680, 680' and 680" is lowered, and the reliability of the FED can be improved.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A field emission pixel, comprising:

a cathode on which a field emitter for emitting electrons is formed;

an anode on which a phosphor for absorbing the electrons emitted from the field emitter is formed; and a thin film transistor (TFT) having a source connected to a current source in response to a scan signal, a gate for receiving a data signal, and a drain connected to the field emitter.

2. The field emission pixel of claim 1, further comprising:

a field emitter gate for inducing field emission from the field emitter on the cathode.

3. The field emission pixel of claim 1, wherein the TFT comprises at least two transistors having gates to which a same signal is applied and connected in series to each other.

4. The field emission pixel of claim 3, wherein a transistor connected to the field emitter among the at least two transistors connected in series to each other includes a transistor capable of sustaining a drain voltage of 25 V or more.

5. The field emission pixel of claim 4, wherein the transistor connected to the field emitter among the at least two transistors connected in series to each other has an offset length to prevent a gate and a drain from vertically overlapping each other.

6. The field emission pixel of claim 1, wherein the cathode comprises at least two field emitters, and the TFT comprises at least two transistors having gates to which a same signal is applied, sources to which the same signal is applied, and drains respectively connected to the field emitters.

7. The field emission pixel of claim 6, further comprising:

a field emitter gate formed in a single plate covering all the at least two field emitters and inducing field emission from the field emitters.

8. The field emission pixel of claim 6, further comprising:

field emitter gates respectively formed in the at least two field emitters and inducing field emission from the field emitters.

9. The field emission pixel of claim 1, wherein an active layer of the TFT includes a semiconductor film such as amorphous silicon, micro-crystalline silicon, polycrystalline silicon, wide-band gap material like ZnO, or an organic semiconductor.

10. The field emission pixel of claim 1, wherein the field emitter includes a carbon material.

* * * * *